United States Patent [19]

Justus

[11] Patent Number: 4,561,939

[45] Date of Patent: Dec. 31, 1985

[54] EXTENDED NIP PRESS ARRANGEMENT

[75] Inventor: Edgar J. Justus, Beloit, Wis.

[73] Assignee: Beloit Corporation, Beloit, Wis.

[21] Appl. No.: 593,257

[22] Filed: Mar. 26, 1984

[51] Int. Cl.[4] ..... D21F 3/04

[52] U.S. Cl. ..... 162/360.1; 162/205; 162/305; 162/306; 162/358

[58] Field of Search ..... 162/358, 360.1, 305, 162/306, 205

[56] References Cited

U.S. PATENT DOCUMENTS

| | | | |
|---|---|---|---|
| 2,653,523 | 9/1953 | Hornbostel | 162/360.1 |
| 3,215,592 | 11/1965 | Justus et al. | 162/358 |
| 3,268,390 | 8/1966 | Ely, Sr. | 162/360.1 |
| 3,671,389 | 6/1972 | Wahlstrom et al. | 162/205 |
| 4,016,032 | 4/1977 | Kankaanpaa | 162/360.1 |
| 4,201,624 | 5/1980 | Mohr et al. | 162/360.1 |
| 4,219,383 | 8/1980 | Valkama | 162/360.1 |
| 4,287,021 | 9/1981 | Justus et al. | 162/205 |

FOREIGN PATENT DOCUMENTS

| | | | |
|---|---|---|---|
| 395841 | 10/1908 | France | 162/360.1 |
| 697338 | 9/1953 | United Kingdom | 162/360.1 |

OTHER PUBLICATIONS

Justus et al., "Development of Extended Nip Press" TAPPI Conference, Sep. 1981.

*Primary Examiner*—S. Leon Bashore
*Assistant Examiner*—K. M. Hastings
*Attorney, Agent, or Firm*—Hill, Van Santen, Steadman & Simpson

[57] ABSTRACT

A paper machine press with a web being picked off a forming wire and passed through a first two roll nip sandwiched between upper and lower felts, the web transferred to the lower felt and then to a felt of a second press with the second double felted press being an extended nip type formed between an upper roll and a lower concave shoe with a relieved leading edge and a water impervious belt passing through the nip sliding over the shoe with the belt being guided on an annular stationary guide, the web transferred to the upper felt following the extended nip by a suction shoe within the felt and thereafter the web being transferred to a fifth felt.

1 Claim, 1 Drawing Figure

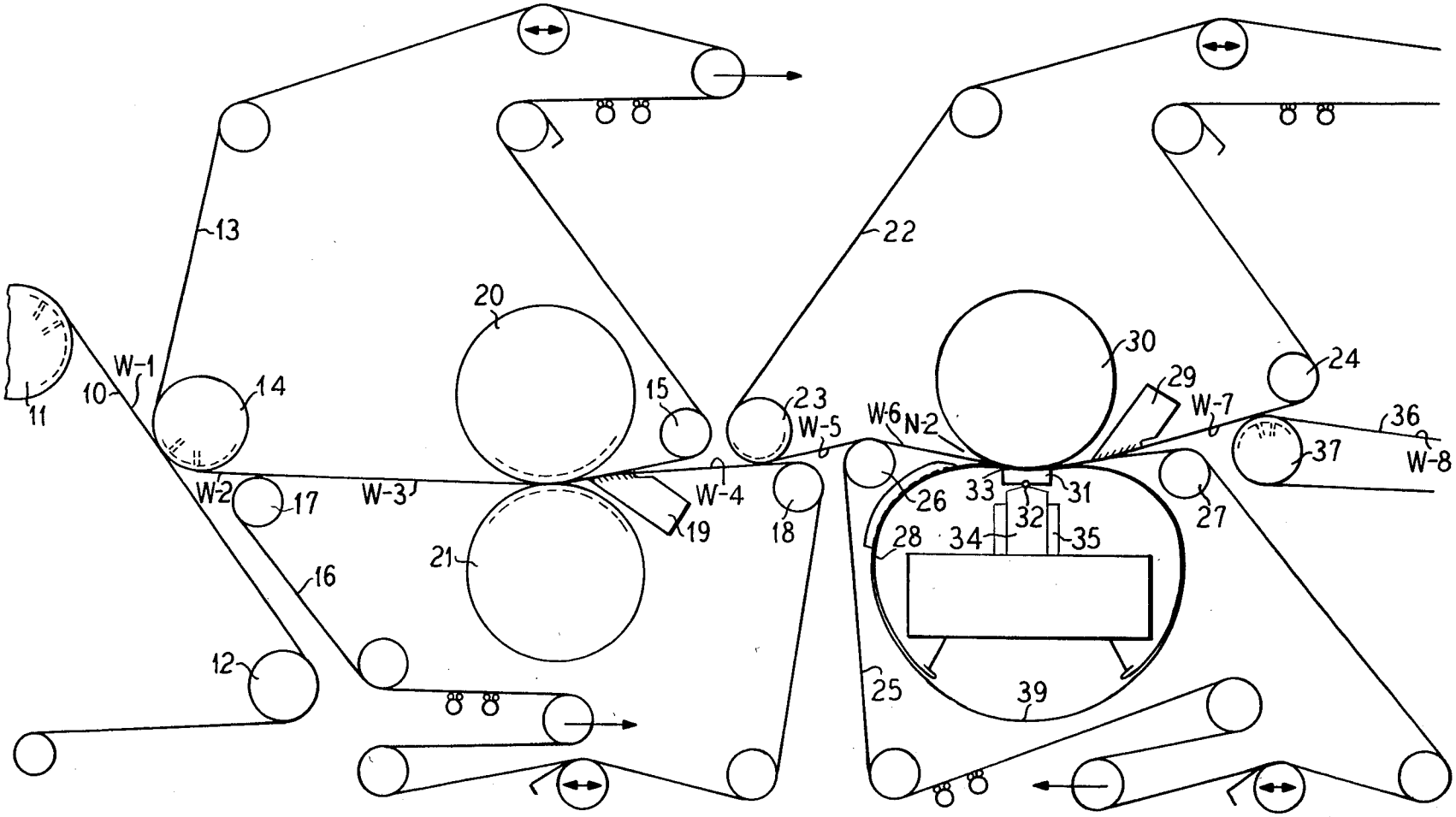
10
11
12
13
14
15
16
17
18
19
20
21
22
23
24
25
26
27
28
29
30
31
32
33
34
35
36
37
39
W-1
W-2
W-3
W-4
W-5
W-6
W-7
W-8
N-2

EXTENDED NIP PRESS ARRANGEMENT

BACKGROUND OF THE INVENTION

The invention relates to improvements in paper machines, and more particularly to an improved pressing arrangement for dewatering a web received from a forming section of a papermaking machine.

In a press section of a papermaking machine, an important object is to remove as much water from the web as possible without damaging the formation or crushing the web. It is a well known fact that with every additional removal of even a fraction of a percent of water from the web, great savings in energy are accomplished. The water which is not removed in the press must be removed thermally in the dryer drum section of the paper machine, and the energy requirements for the removal of a unit of water by evaporation greatly exceed the energy requirements for removal of the same unit of water by pressing.

It is well known from a review of the pressing art that a great many press arrangements have been proposed and used with varying degrees of success. It is not apparent from a study of the pressing art or the pressing structure arrangements available in the art what changes should be made to improve pressing operation and improved presses have been arrived at substantially wholly through discovery and invention because minor variances can often effect substantial improvement in water removal without any prior indication as to why such variance should accomplish an improvement. The combinations and permutations of arrangements of felts and press rolls are substantially infinite, but with these infinite permutations and combinations, many arrangements will not effect improvements in dewatering and many will essentially be inoperative because of too much water being left in the web or because of the web experiencing crushing or other phenomena which results in a poor paper sheet at the delivery end of the machine.

It is accordingly an object of the present invention to provide an improved paper machine press section which is capable of removing an increased amount of water from a traveling web and is capable of satisfactory dewatering at higher machine speeds.

A further object of the invention is to provide an improved paper machine press which utilizes the improved effects of an extended nip press and utilizes a combination of a conventional two roll press with an extended nip press. A still further object of the present invention is to provide an improvement in papermaking machines for providing an improved quality web and reducing energy requirements of a papermaking machine by an improved press section.

Other objects, advantages and features will become more apparent with the teaching of the principles of the invention in connection with the disclosure of the preferred embodiment thereof in the specification, claims and drawings, in which:

DESCRIPTION OF THE DRAWINGS

The single FIGURE of the drawing is a somewhat schematic front elevational view of a paper machine press section embodying the principles of the present invention.

DESCRIPTION OF THE PREFERRED EMBODIMENT

As shown on the drawing, a formed paper web travels from a forming section through the illustrated press section. The web is designated by W and is transferred to various supporting elements in different positions through the machine as indicated by the numerals W-1 through W-8.

The web is formed on a forming wire which may be a Fourdrinier wire or the lower wire of a twin wire machine, and the wire is designated at 10 passing down over a couch roll 11 and a turning roll 12 in a descending pick-off run. This position of the web prior to being picked off the wire is designated at W-1.

The web is then transferred to an upper first press felt 13 which passes downwardly into close running relationship with the wire 10 and picks the web off the wire because of a suction pick-up roll 14. The web in being picked off the wire follows the felt 13 into position W-2.

A lower felt 16 is guided up into close running relation with the upper felt 13 passing over a guide roll 17 so that the web W-2 becomes sandwiched therebetween passing into position W-3.

Both felts 13 and 16 with the web sandwiched therebetween pass into a first nip N-1. The nip N-1 is formed between an upper roll 20 and a lower roll 21. Preferably both rolls are open rolls and are pressed together with a nip pressure in the range of 400 to 800 pli.

Following the nip N-1, the felts are separated with the upper felt 13 passing over the guide roll 15, and the lower felt 16 traveling onto guide roll 18.

Web transfer to the lower felt 16 is effected by a suction shoe 19, and the web follows the lower felt into the position shown at W-4 as the felts separate.

In the nip N-1, the relatively wet web is pressed for initial water removal with the water passing into the felts and into the grooves of the rolls 20 and 21. The felts in their total run pass over guide rolls, felt dryers and cleaners and felt stretch rolls in a manner which will be well known to those versed in the art, and the additional felt guide and felt treatment rolls are not numbered.

From the position W-4 where the web is on the lower felt 16, web transfer is effected onto a third upper felt 22. The felt 22 passes down over a felt transfer suction roll 23 so that the web is carried on the lower surface of the felt 22 in position W-5. The web then passes into the second nip N-2 of an extended nip press. For the pressing operation in the second nip, the web is double felted being sandwiched between the upper felt 22 and a lower felt 25 which is brought up against the lower surface of the lower felt by a guide roll 26 so that the web is in the position W-6.

The double felts 22 and 25 with the web sandwiched therebetween pass into the nip N-2 which is formed between an upper press roll 30 which may be an open roll, and a press shoe 31.

The press shoe 31 is supported on a pivot pin 32 and has a concave upper surface to form an extended press nip. The leading edge 33 of the shoe is relieved so that when a lubricating liquid is supplied thereto by lubricating supply means 38, a hydraulic layer of pressing liquid builds up between the upper surface of the shoe and a looped impervious belt 39. The belt 39 passes through the nip with the felts. The shoe is pressed upwardly being supported on a piston 34 in a cylinder 35 with liquid pressure being supplied beneath the piston by suitable pressurizing means. The shoe is pressed upwardly by a force to give a larger pressing pressure in the nip N-2 than in the first nip N-1, and preferably a pressure in the range of 4000 to 8000 pli is applied.

The looped impervious belt 39 is guided on an annular shoe arrangement which is slightly less than the diameter of the belt 39 so that the belt is guided and slides freely over the annular guide arrangement 28.

Following the extended nip, the web is transferred to the upper felt 22 by a suction shoe 29 within the upper felt. The web then is in the location W-7. The lower felt 25 is guided away from the upper felt by a guide roll 27. The upper and lower felts 22 and 25 pass over suitable felt cleaning and drying means and felt guide rolls and stretch rolls in a manner which will be well known to those versed in the art so that the elements need not be described in detail and they are not numbered on the drawing.

Following the transfer of the web to the position W-7, the web is transferred to a fifth felt 36 which passes over a suction roll 37 for the transfer. The web is then in the position W-8 to pass downstream to dryer drums.

In operation the web is picked off the forming wire 10 and passes sandwiched the between upper and lower first felts 13 and 16 into the first nip N-1 formed between the upper and lower press rolls 20 and 21. On the offrunning side of the nip N-1, the web is transferred to the lower felt by the suction shoe 19 and then transferred to the third felt by the suction roll 23. The web is carried in the position W-6 sandwiched between the second set of felts 22 and 25 into an extended nip press. The extended nip press is formed between the upper roll 30 and the lower press shoe 31. Following the second extended nip press, the web is transferred to the upper felt by a suction shoe 29, and from position W-7 is transferred onto the fifth felt 36 by the suction roll 37 into position W-8.

Thus, it will be seen that I have provided a new and unique pressing arrangement wherein the web is first dewatered in a regular two roll press to remove a large amount of water from the wet web into the two carrying felts. Thereafter, the web is passed into an extended nip press where pressure is applied for an extended time with the bulk of the first excess water having been removed in the first press and the complete pressing operation is finished in the second extended nip. The second press is also a double felted press with the water being removed in both directions and with both nips being double felted presses, the press arrangement is particularly well suited to use in forming one sided paper which may be formed by a twin wire former. Essentially dewatering is accomplished at a substantial rate in both directions in each of the press nips.

I claim as my invention:

1. A paper machine structure comprising in combination:

a web forming wire having a downwardly extending run;

a first upper press felt with a pick-up roll therein arranged in close running relationship with the wire to transfer a web thereform onto the first felt;

a second lower felt guided into pressing relationship with the first felt to sandwich a web therebetween;

a first press roll couple with upper and lower press rolls forming a first press nip pressing the first and second felts therebetween with said rolls being open rolls;

a web transfer suction shoe within the lower felt transferring the web to the lower felt following the first nip;

a third upper press felt arranged in close running relationship with the second felt and having a suction roll therein to transfer the web from the second felt to the third felt;

a fourth lower press felt passing through the second nip with the web therebetween;

an endless impervious belt arranged to meet the fourth felt and carry the web through an extended second nip;

an upper roll and a lower concave shoe forming the extended second nip with the lead end of the shoe relieved to form a dynamic film of fluid between the belt and shoe;

an arcuate stationary guide surface means within the the belt to guide it in operation in a substantially annular path;

a fluid piston and cylinder beneath the shoe to support it and provide pressure within the extended press nip;

a suction transfer shoe within the third felt following the second nip to transfer the web to the third felt;

and a fifth felt positioned in close running relationship with the third felt with a suction means therein to transfer the web to the fifth felt.

* * * * *